United States Patent [19]

Kufferath

[11] Patent Number: 4,867,206

[45] Date of Patent: Sep. 19, 1989

[54] DRAINAGE BELT FOR PRESSES IN THE WET SECTION OF A PAPER MACHINE

[76] Inventor: Franz F. Kufferath, Lommessemstrasse 37, 5160 Düren, Fed. Rep. of Germany

[21] Appl. No.: 57,689

[22] Filed: Jun. 1, 1987

Related U.S. Application Data

[63] Continuation-in-part of Ser. No. 755,807, Jul. 17, 1985, abandoned.

[30] Foreign Application Priority Data

Jul. 17, 1984 [DE] Fed. Rep. of Germany ..... 3426264

[51] Int. Cl.[4] ..... D03D 15/00

[52] U.S. Cl. ..... 139/383 A; 139/425 A; 162/DIG. 1

[58] Field of Search ..... 139/383 A, 425 A; 162/DIG. 1; 428/224, 234, 257

[56] References Cited

U.S. PATENT DOCUMENTS

| | | | |
|---|---|---|---|
| 2,949,134 | 8/1960 | Hindle et al. | 139/383 A |
| 3,214,326 | 10/1965 | Lee . | |
| 4,356,844 | 11/1982 | Thompson | 139/383 A |
| 4,564,051 | 1/1986 | Odenthal | 139/383 A |
| 4,569,375 | 2/1986 | Borel | 139/383 A |

FOREIGN PATENT DOCUMENTS

| | | |
|---|---|---|
| 0089032 | 9/1983 | European Pat. Off. . |
| 0141791 | 5/1985 | European Pat. Off. . |
| 1461105 | 12/1968 | Fed. Rep. of Germany . |
| 3225599 | 1/1984 | Fed. Rep. of Germany . |
| 3305713 | 4/1984 | Fed. Rep. of Germany . |

*Primary Examiner*—Henry S. Jaudon
*Attorney, Agent, or Firm*—Wigman & Cohen

[57] ABSTRACT

In a drainage belt for presses in the wet section of a paper machine, which belt includes a porous support belt (3,4) in the form of a screen webbing and a finely porous cover layer (1,2) on the side of the support belt (3,4) facing the paper web, the cover layer (1,2) is formed by a shape-retaining single-plane screen webbing which forms drainage channels.

4 Claims, 5 Drawing Sheets

DRAINAGE BELT FOR PRESSES IN THE WET SECTION OF A PAPER MACHINE

BACKGROUND OF THE INVENTION

This application is a continuation-in-part of application Ser. No. 755,807, filed July 17, 1985 now abandoned.

The invention relates to a drainage belt for a press in the wet section of a paper machine.

In the press section of a paper machine, the paper web lying on a drainage belt or lying between two drainage belts is guided through the nip of at least one press, which uses mechanical pressure to press out a portion of the water contained in the paper web. The purpose of the drainage belt or belts is to absorb the water pressed out of the paper web.

In order to increase the drainage capacity of a press, it is known to place a wire beneath the wet felt lying on the paper web, and to allow this screen to run through the nip as a separate element. The web felt thereby forms a finely porous covering and the wire forms a porous support belt.

In the modern presses, the drainage capacity of the drainage belt formed in this manner is fully utilized, i.e., the drainage belt limits the capacity of the press. The operating speed of the paper machines, however, has not yet reached an upper limit. Furthermore, to reduce steam, and thereby save energy in the drying section, it is desirable to increase the dryness factor of the paper web as it leaves the press section. The increased performance capacity of the press section required to achieve this purpose could previously be achieved only by increasing the number of presses, which means a significant expense. This is also true with the use of a different, known drainage belt, which has a screen webbing as a support belt and a foil perforated by a laser beam as a cover layer, because even its drainage capacity does not exceed that of a drainage belt having a felt as a cover layer.

SUMMARY AND OBJECTS OF THE INVENTION

The object of the invention is to create a drainage belt for presses in the wet section of a paper machine, which makes it possible to increase the drainage capacity of a wet press.

A drainage belt of this type does not lose its openness under pressure in the nip. Therefore, the water absorption capacity is increased not only by the embodiment of the cover layer as a screen webbing, but also, primarily, by the fact that the water absorption capacity of the entire drainage belt can be fully utilized. One therefore need only select the open space of the drainage belt to be at least large enough that it can absorb all of the water removed from the paper web in the nip in order to increase the capacity of the press. Because the cover layer does not lose its openness in the compression nip, due to the embodiment as a shape-retaining, single-plane screen webbing which forms drainage channels, even the permeability of the drainage belt can be adjusted without difficulty, so that no critical hydraulic pressure can build up in the nip, which could lead to a destruction of the paper web. An additional advantage of the drainage belt according to the invention is that the water stored therein can easily be removed by centrifugal force as the belt is diverted about a roller or by aspiration. Finally, the drainage belt according to the invention also is better than the known drainage belts at preventing a remoistening of the paper web, i.e. a back flow of the water out of the drainage belt into the paper web as it leaves the compression nip.

The drainage belt according to the invention, which makes possible not only a vertical drainage flow but also a transverse drainage flow, permits a controlling of the water absorption and thereby an optimalization of the drainage capacity under different conditions, by means of the embodiment of the cover layer and the support belt as well as the cooperation of both elements.

In addtion, it contributes to an improvement in the sheet formation. For example, the uniform drainage capacity over the entire width of the belt can avoid surface weight fluctuations in the paper web. Furthermore, the compressibility of the paper web is made more uniform, i.e., the characteristics of the two sides of the paper web that are material to compressibility more nearly approach each other.

A further advantage of the drainage belt according to the invention is seen in the fact that its drainage may be accomplished at a lower consumption of energy than is possible with the commonly used web felts.

To further improve the drainage capacity, the drainage channels in the cover layer can be enlarged toward the support belt. This is also advantageous with respect to having the smallest possible remoistening of the paper web. Furthermore, the permeability of the support belt for water and air, advantageously, is greater than that of the cover layer. Preferably, the permeabilities of the two layers are adjusted to each other such that they are equivalent to a funnel which opens toward the underside of the support belt opposite the cover layer.

In one preferred exemplary embodiment, the number of drainage channels in the cover layer is larger than in the support belt. It is also advantageous if the screen webbing of the cover layer is substantially less thick than that of the support belt.

The characteristics of both the cover layer and the support belt can be particularly well adapted to the given requirements if the cover layer and/or the support belt are formed in multiple layers, whereby the individual layers can have different forms.

Other advantageous embodiments of the drainage belt according to the invention are the object of additional dependent claims.

BRIEF DESCRIPTION OF THE DRAWINGS

The invention is described in greater detail below with the aid of exemplary embodiments illustrated in the unscaled drawings.

DETAILED DESCRIPTION OF PREFERRED EMBODIMENTS

Figure 1:
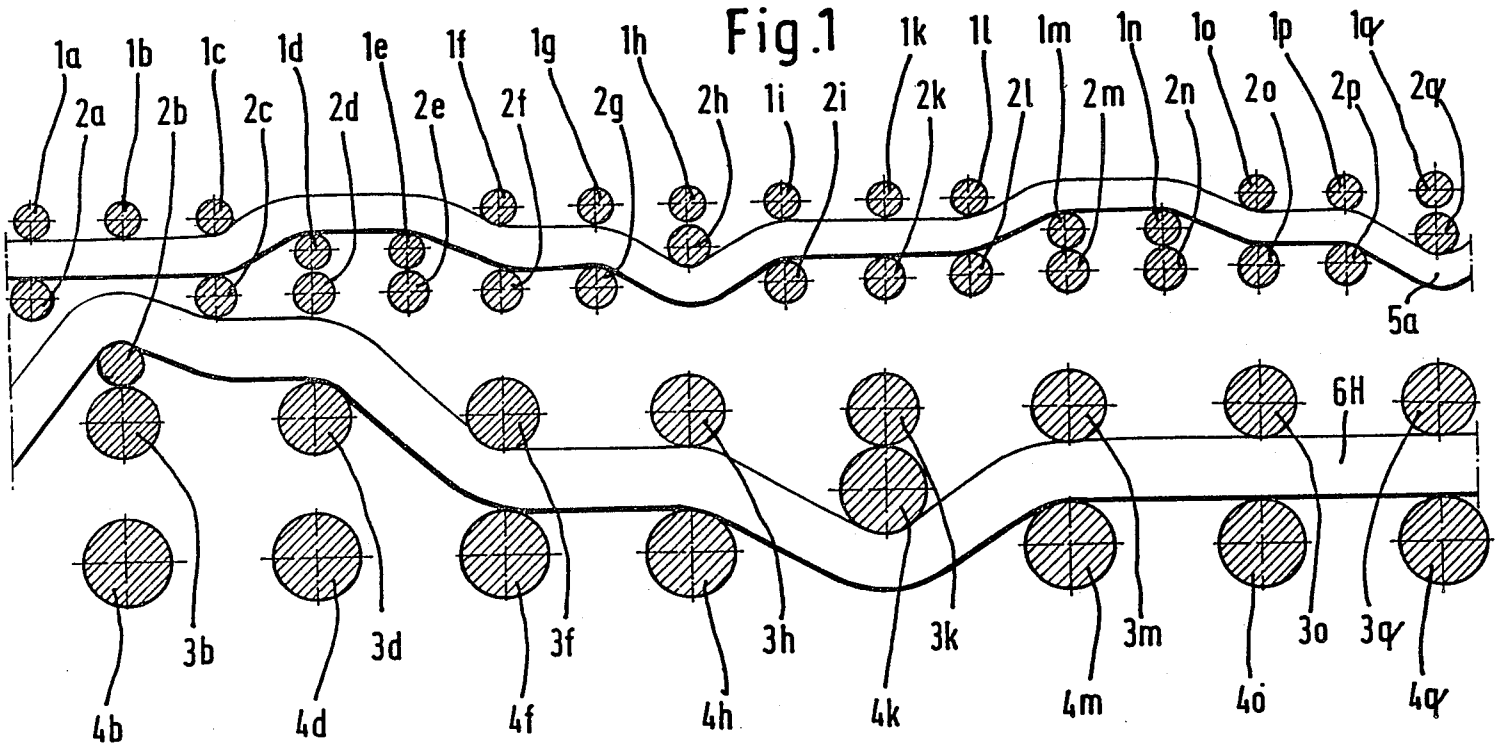
FIG. 1 is a longitudinal cross-section according to Line I—I in FIG. 4.
Figure 2:
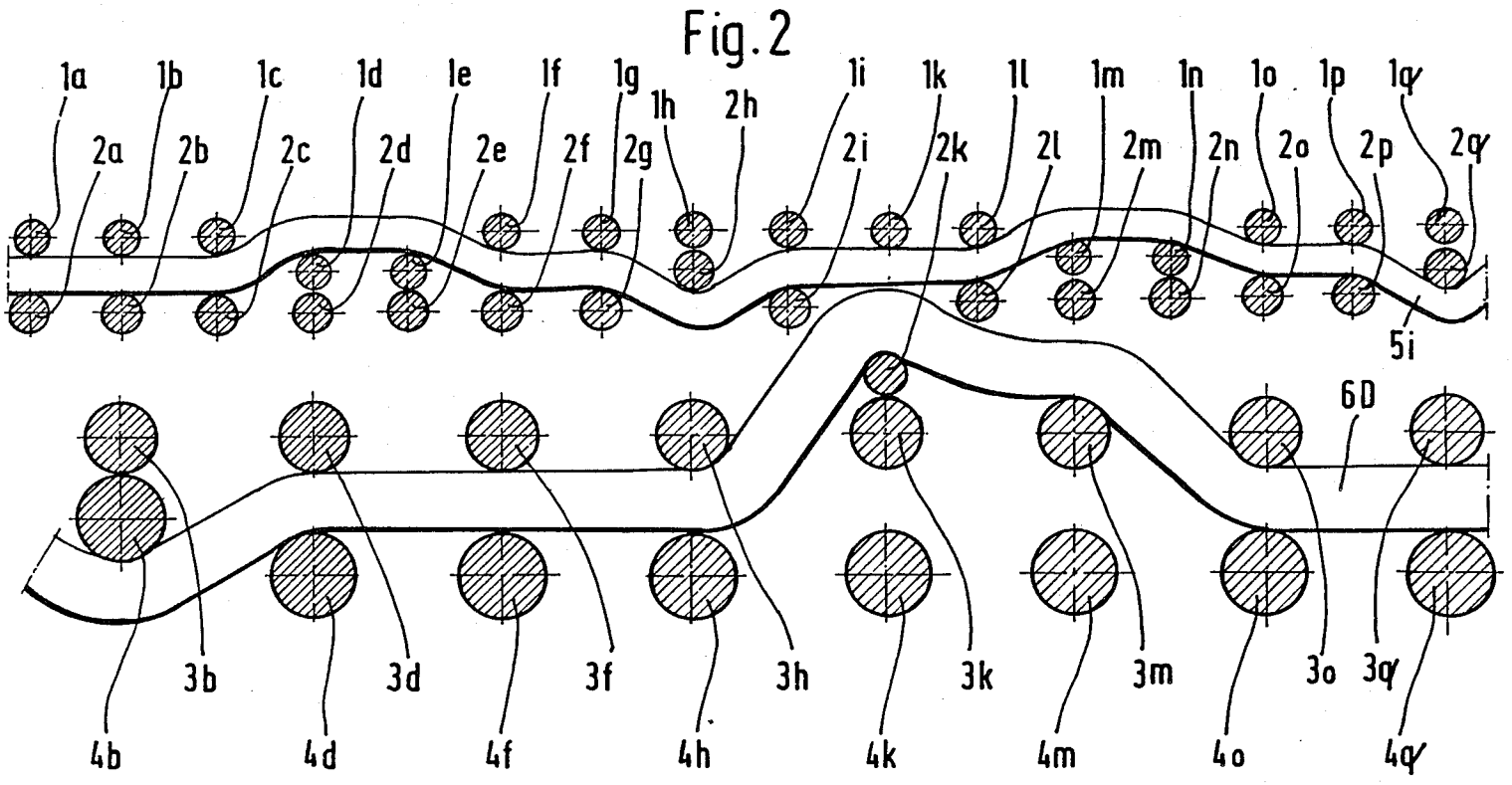
FIG. 2 is another longitudinal cross-section according to Line II—II in FIG. 4.
Figure 3:
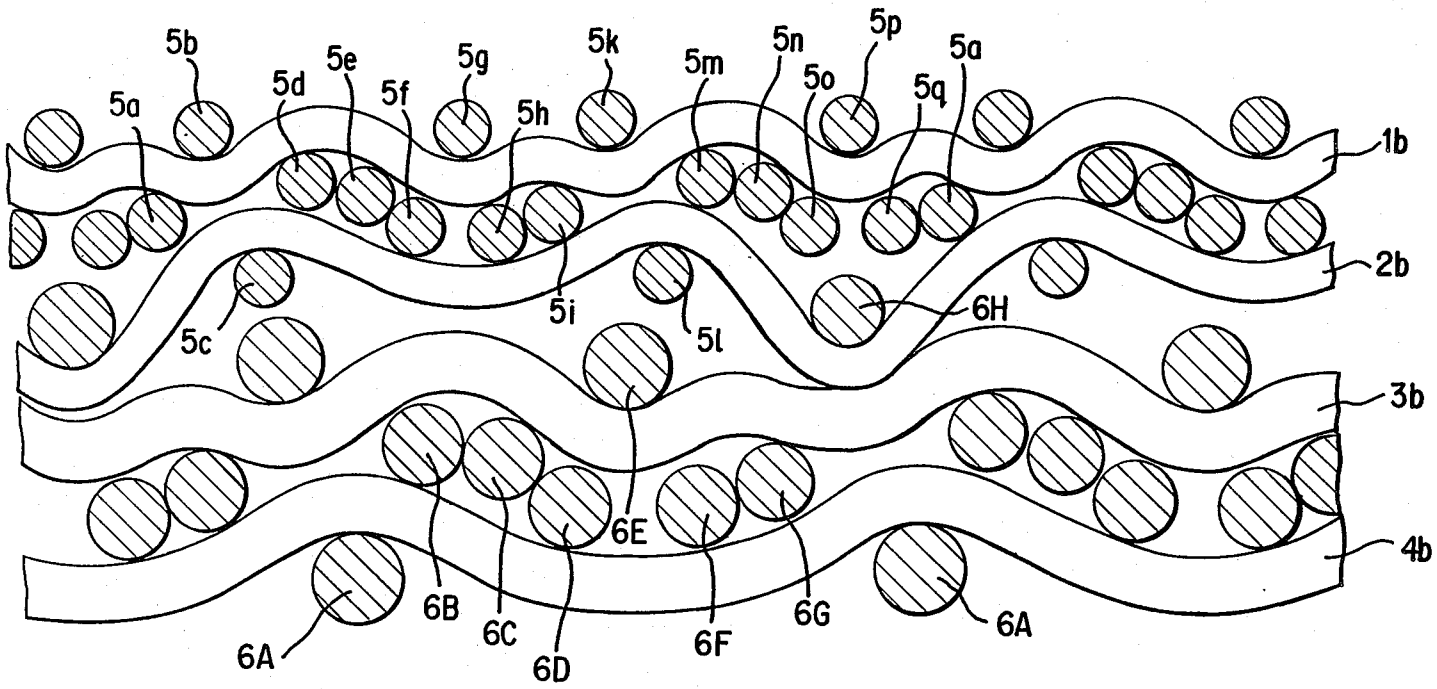
FIG. 3 is a transverse cross-section according to Line III—III in FIG. 4.

As shown in FIGS. 1–3, the drainage belt according to the first embodiment is comprised of four layers or systems of yarns running in the transverse direction of the belt. These yarns are usually the wefts. The four systems or layers of yarns are disposed one above the other. In FIGS. 1 and 2, with the belt lying in a horizontal plane, the yarns are vertically disposed with respect to one another. The uppermost layer, which comes into contact with the paper web, is designated with the numerals 1*a*–1*q*, the yarn layer lying immediately beneath the first such layer is designated with the numerals 2*a*–2*q*, the yarn layer lying beneath layer 2*a*–2*q* is designated with the numerals 3*b*–3*q*, and the bottom yarn layer, which forms the running surface of the drainage belt, is designated with the numerals 4*b*–4*q*. The uppermost yarn layer 1*a*–1*q* has 28 yarns per cm, each having a diameter of 0.15 mm. The yarns of the yarn layer 2*a*14 2*q* lying immediately beneath the layer 1*a*–1*q*, have a diameter of 0.18 mm and lie precisely beneath the yarns of the uppermost layer 1*a*–1*q*. The uppermost yarn layer 1*a*–1*q* and the yarn layer 2*a*–2*q* lying thereunder, which can also be designated as the first intermediate layer, are connected with each other by a first longitudinal yarn system or warp 5*a*–5*q*, which consists of 72 longitudinal yarns having a diameter of 0.15 mm. The course of the yarns of this first longitudinal yarn system or warp 5*a*–5*q* can be seen in FIGS. 1–3 in which it is apparent that a portion of longitudinal yarn system 5*a*–5*q*, together with yarn layer 1*a*–1*q*, contacts the paper web. Two adjacent yarns of the uppermost yarn layer 1*a*–1*q* are tied in at intervals. The longitudinal yarns then run between the next two yarns of the uppermost yarn layer 1*a*–1*q* and the yarns of the layer 2*a*–2*q* aligned with said yarns of the layer 1*a*–1*q*, then tying in one yarn of the first intermediate layer 2*a*–2*q*, and then run past three yarns between the uppermost layer 1*a*–1*q* and the first intermediate layer 2*a*–2*q*. Although the diameter of the yarns of the uppermost yarn layer 1*a*–1*q* is smaller than the diameter of the yarns of the first intermediate layer 2*a*–2*q*, the openness of the layer 1*a*–1*q* relative to the first intermediate layer 2*a*–2*q* is reduced by the reinforced tying in of the longitudinal yarns into the uppermost yarn layer 1*a*–1*q*. Because the longitudinal yarns of the longitudinal yarn system 5*a*–5*q* run at about 50%, relative to its overall length, between the uppermost yarn layer 1*a*–1*q* and the first intermediate layer 2*a*–2*q* lying immediately thereunder, both layers form not only channels penetrating these layers in a perpendicular direction, but also a first flow channel system is created in the longitudinal direction of the belt between these two layers, which together form the cover layer of the drainage belt. The uppermost yarn layer 1*a*–1*q* and the first intermediate layer connected therewith by the first longitudinal yarn system 5*a*–5*q* have open space for water storage of about 50% of their volume. The integral permeability of both layers, measured by air passage at a negative pressure of 10 mm water column, is 1420 $1/m^2s$.

The yarn layer 3*b*–3*q* lying beneath the first intermediate layer 2*a*–2*q*, which layer 3*b*–3*q* can also be designated as the second intermediate layer, has 14 yarns per cm with diameters of 0.30 mm. The yarns of the lower yarn layer 4*b*–4*q* are arranged precisely below that of the second intermediate layer 3*b*–3*q*, so that the bottom yarn layer 4*b*–4*q* also has 14 yarns per cm. The fiber diameter here, however, is 0.35 mm. The second intermediate layer 3*b*–3*q* and the bottom yarn layer 4*b*–4*q*, which together form the support belt, are connected with each other by a second longitudinal yarn system 6A-6H, which has 35 longitudinal yarns per cm. The fiber diameter is 0.27 mm. The tying in of the yarns of the second intermediate layer 3*b*–3*q*, and those of the bottom yarn layer 4*b*–4*q* by means of the second longitudinal yarn system 6A-6H, as shown in the drawing, is performed in the same manner as with the uppermost yarn layer 1*a*–1*q* and the first intermediate layer 2*a*–2*q*. Here, too, the longitudinal yarn system 6A-6H ties reinforcingly into the second intermediate layer 3*b*–3*q*, which has the result that also in the support belt the webbing opens from the second intermediate layer toward the bottom yarn layer 4*b*–4*q*. The webbing portion of the drainage belt consisting of the second intermediate layer 3*b*–3*q* and the bottom yarn layer 4*b*–4*q* has an integral open screen space of 60% with an overall permeability of 2500 $1/m^2s$.

The hydraulic radius of the first intermediate layer 2*a*–2*q* is 1.12 fold, the hydraulic radius of the second intermediate layer 3*b*–3*q* is 1.96 fold and the hydraulic radius of the bottom yarn layer 4*b*–4*q* is 2.20 fold of the hydraulic radius of the uppermost yarn layer 1*a*–1*q*. Therefore, the channels penetrating the drainage belt in a perpendicular direction are equivalent to a funnel opening toward the underside of the belt.

The support belt is connected with the second intermediate layer 3*b*–3*q* by means of the second longitudinal yarn system 6A-6H as shown in FIGS. 1–3. Only one of sixteen successive yarns of layer 2*a*–2*q* is tied in by each yarn of yarn system 6A-6H.

Instead of such a connection all four yarn layers could be connected with each other by means of third longitudinal yarn system having a lower yarn count. This third longitudinal yarn system could consist of twisted yarn having a diameter of 0.15 mm.

Figure 4:
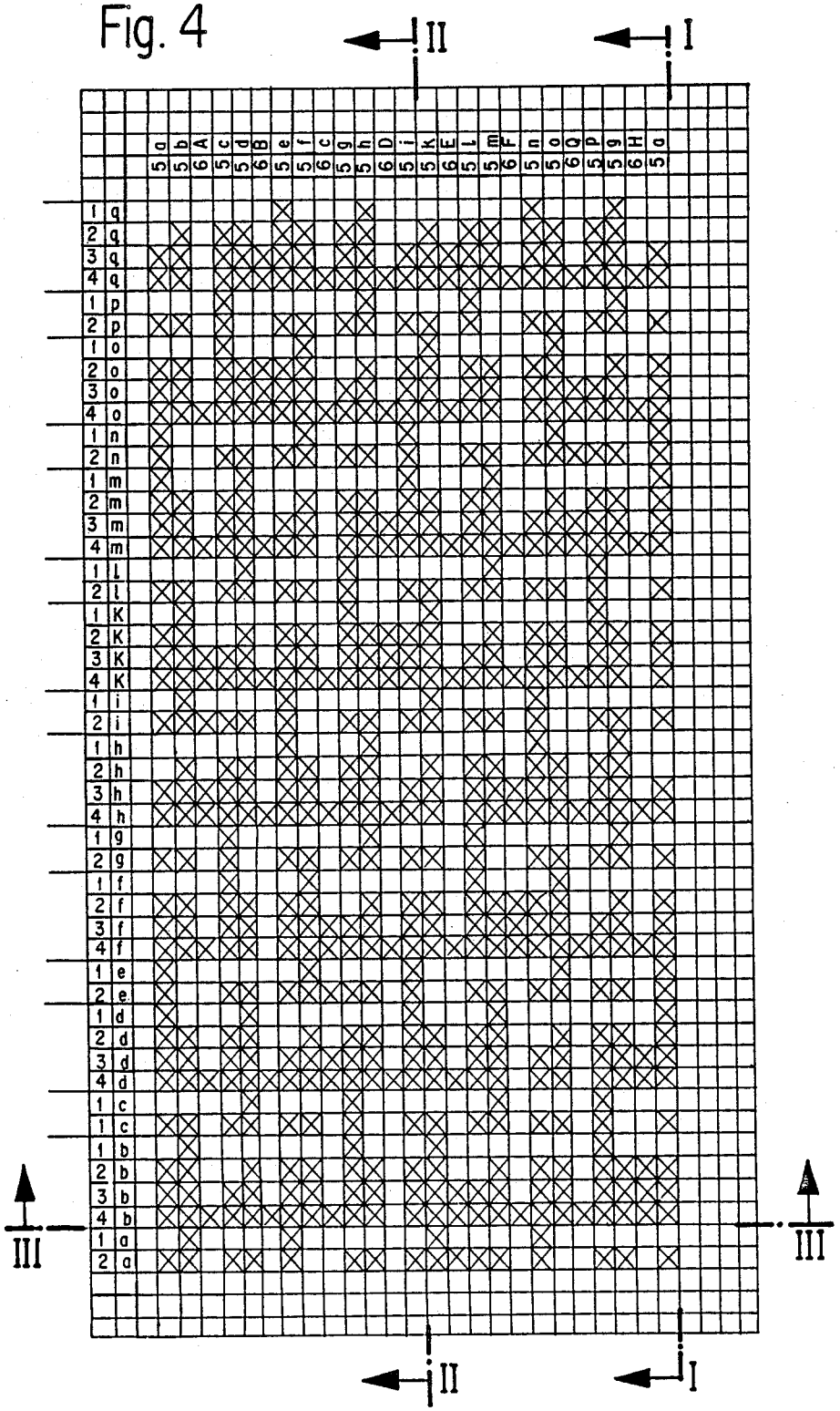
FIG. 4 is the pattern showing the relationship of the warp and weft yarns of the embodiment according to FIGS. 1–3.

The pattern shown in FIG. 4 shows, for all yarns of one repeat crossing another yarn within this repeat, which yarn lies above the other at the intersection. A cross means that the longitudinal yarn lies above the crossed transverse yarn. In reading the pattern it is to be noted that all transverse yarns having the same reference character, for instance the character b, lie one above the other and not, as shown in the pattern, side by side.

The drainage belt formed in the above manner has an overall thickness of 1.6 mm. Of this, the uppermost yarn layer 1*a*–1*q* comprises about 0.25 mm, the first intermediate layer 2*a*–2*q* lying immediately thereunder comprises about 0.30 mm, the second intermediate layer 3*b*–3*q* comprises about 0.45 mm and the bottom yarn layer 4*b*–4*q* comprises about 0.6 mm. The openness of the drainage belt lies well above 50% and the drainage belt is nearly incompressible. As shown by FIGS. 1–3 the drainage belt is mono-plane or single-plane, i.e., the upper side of those parts of longitudinal yarns 5*a*–5*q* lying above the yarns of uppermost yarn layer 1*a*–1*q* lies in the plane defined by the uppermost yarn layer which contacts the paper web.

Figure 5:
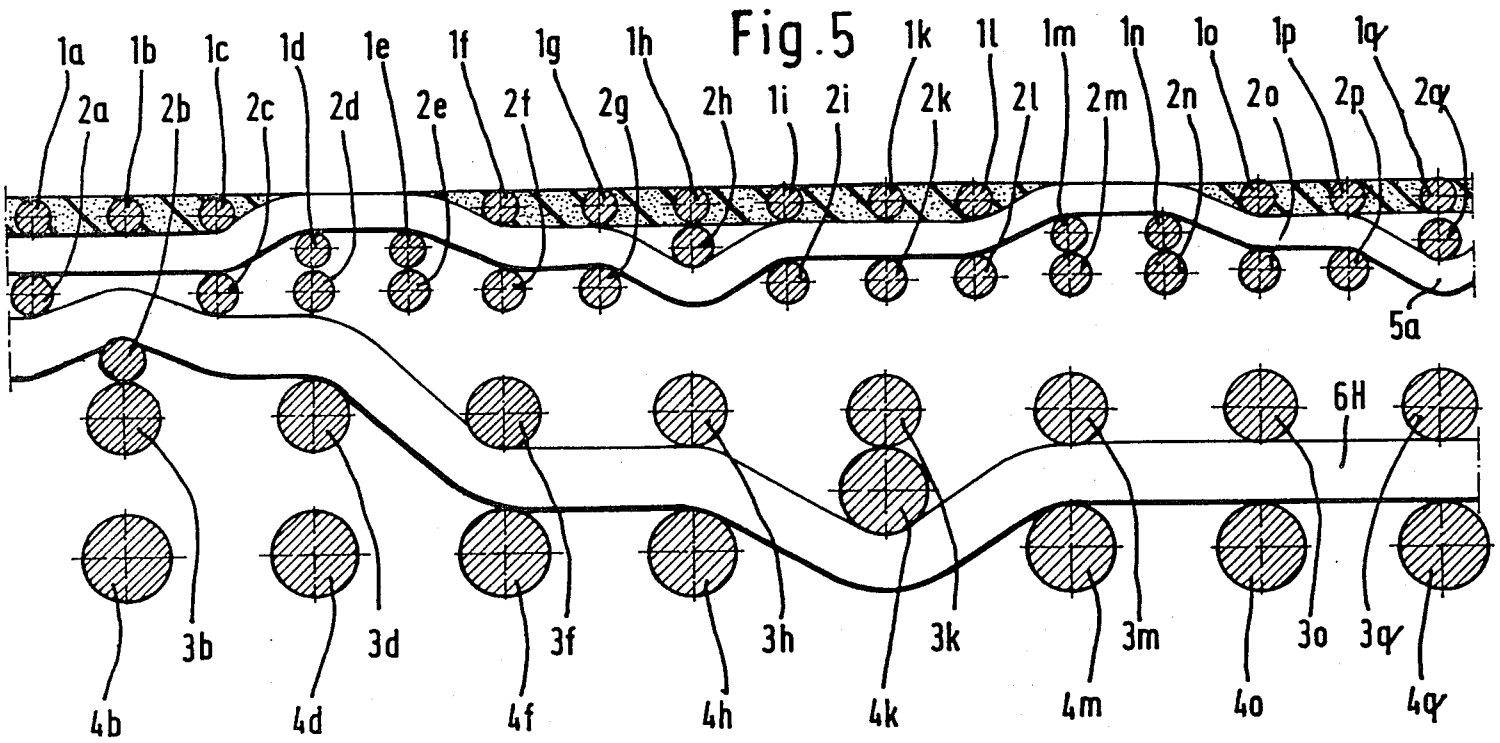
FIG. 5 is a longitudinal cross-section corresponding to FIG. 1 of a second embodiment.

The embodiment of FIG. 5 differs from the embodiment of FIGS. 1–4 only by an open-pore foam material which is provided between the yarns of the uppermost yarn layer 1*a*–1*q*. Of course this foam material reduces the hydraulic radius of layer 1*a*–1*q* so that the funnel effect is increased. Further the side of the drainage belt facing the paper web is smoother. However, on the other side by the foam material, there is a risk of obstruction whereas embodiments without foam material do not change their qualities.

All characteristics mentioned in the above specification as well as those that can be obtained only from the drawing are components of the invention as further embodiments, even if they are not especially emphasized and particularly not mentioned in the claims.

What I claim is:

1. A drainage belt for presses in the wet section of a paper machine, comprising:

a porous support belt in the form of a screen web and a finely porous cover layer on the side of the support belt facing the paper web, wherein the cover layer is a shape-retaining, single-plane screen web forming drainage channels, said cover layer and support belt being linked by a longitudinal yarn system;

wherein the drainage channels of the cover layer become larger toward the support belt; and wherein said drainage channels are formed such that the permeability of the support belt for water and air is greater than that of the cover layer and in that the permeability degrees of both layers are adapted to each other in such a manner that they are equivalent to a funnel opening toward the underside of the support belt opposite the cover layer, wherein the support belt and the cover layer are formed in multiple layers.

2. The drainage belt according to claim 1, wherein the individual layers of the transverse yarns have different permeabilities.

3. A drainage belt, comprising:

a first layer of transverse yarns having a first diameter;

a second layer of transverse yarns having a second diameter;

a support layer of transverse yarns having a diameter larger than the first and second diameters;

a longitudinal yarn system interwoven with the first and second layers to create open space, forming drainage channels in said drainage belt from said first layer to said support layer, wherein the drainage channels become progressively larger from said first layer to said support layer; and wherein said drainage channels are formed such that the permeability of the support belt for water and air is greater than that of the cover layer and in that the permeability degrees of both layers are adapted to each other in such a manner that they are equivalent to a funnel opening toward the underside of the support belt opposite the cover layer, wherein the support layer comprises at least two layers of yarn interwoven with a second longitudinal yarn system.

4. The drainage belt according to claim 3, wherein said first, second, and support layers of yarn each comprise a plurality of yarn and the diameters of the yarns of the support layers are larger than the diameters of the yarns of the first and second layers.

* * * * *